US006675784B2

(12) United States Patent
Nagase et al.

(10) Patent No.: US 6,675,784 B2
(45) Date of Patent: Jan. 13, 2004

(54) ENGINE IGNITION SYSTEM HAVING FAIL-SAFE FUNCTION

(75) Inventors: Noboru Nagase, Anjo (JP); Tetsuya Miwa, Nagoya (JP); Makoto Toriyama, Chiryu (JP)

(73) Assignee: Denso Corporation, Kariya (JP)

( * ) Notice: Subject to any disclaimer, the term of this patent is extended or adjusted under 35 U.S.C. 154(b) by 205 days.

(21) Appl. No.: 09/977,335

(22) Filed: Oct. 16, 2001

(65) Prior Publication Data

US 2002/0046745 A1 Apr. 25, 2002

(30) Foreign Application Priority Data

Oct. 24, 2000 (JP) ..... 2000-324393
Feb. 23, 2001 (JP) ..... 2001-048595

(51) Int. Cl.[7] ..... F02P 3/06
(52) U.S. Cl. ..... 123/603; 123/631; 123/640
(58) Field of Search ..... 123/603, 604, 123/631, 640, 198 D, 198 DC, 630, 655, 656; 361/256

(56) References Cited

U.S. PATENT DOCUMENTS 3,754,541 A * 8/1973 Sasayama ..... 123/604
4,892,080 A 1/1990 Morino et al. ..... 123/604
5,056,496 A 10/1991 Morino et al. ..... 123/604
5,446,348 A * 8/1995 Michalek et al. ..... 315/209 SC

* cited by examiner

*Primary Examiner*—Mahmoud Gimie
*Assistant Examiner*—Hai Huynh
(74) *Attorney, Agent, or Firm*—Nixon & Vanderhye P.C.

(57) ABSTRACT

In an engine ignition system having a fail-safe function, a battery, a coil and a transistor are connected in series. A capacitor is connected to the coil by way of a diode. The capacitor, a primary winding of an ignition coil and a transistor are connected in series. A transistor and a diode in serial connection are connected in parallel to the coil and diode in serial connection. A drive circuit turns on and off the transistor to charge the capacitor and operates the transistor to implement the ignition operation. The drive circuit, in the event of system failure, turns on and off the transistor, while retaining the transistor in the on state, thereby to feed energy of the battery to the primary winding.

14 Claims, 10 Drawing Sheets

ENGINE IGNITION SYSTEM HAVING FAIL-SAFE FUNCTION

CROSS REFERENCE TO RELATED APPLICATION

This application is based on and incorporates herein by reference Japanese Patent Applications No. 2000-324393 filed Oct. 24, 2000 and No. 2001-48595 filed Feb. 23, 2001.

BACKGROUND OF THE INVENTION

1. Field of the Invention

The present invention relates to an ignition system for internal combustion engines.

2. Related Art

An ignition system for internal combustion engines is designed to control the primary current flowing through the primary winding of an ignition coil to produce a high voltage at the primary current shut-off time, thereby generating a spark across the air gap of a spark plug. The primary current of the ignition coil is supplied from a d.c. power source (battery).

It is required to keep the ignition operation even in the event of failure of a component part or wiring of the ignition system so that the engine continues to run for the rimp-home performance. It is proposed for this performance to feed the primary current of the ignition coil from an additional separate d.c. power source in the event of system failure. This proposal is not so advantageous from the standpoint of installation space, maintenance and cost of the additional d.c. power source.

SUMMARY OF THE INVENTION

The present invention addresses this situation, and has its object to provide an ignition system for internal combustion engines which has a fail-safe function.

According to the present invention, a first switching device is turned on and off so that energy is stored in an energy storage coil and then the energy is released to charge a capacitor, and during an ignition period a second switching device is turned on and off so that the energy stored in the capacitor is released to the primary winding of an ignition coil to implement the ignition operation.

In the event of system failure, the second switching device feeds energy of a d.c. power source to the primary winding of an ignition coil by way of a reverse current blocking device, thereby enabling the rimp-home performance. In the normal state, the reverse current blocking device prevents the energy stored in the capacitor from flowing back to the d.c. power source.

In this manner, the ignition coil operates by being supplied with energy from the d.c. power source through the bypass at the occurrence of failure in the ignition current path, thereby enabling the rimp-home performance.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

Various embodiments of the present invention will be explained with reference to the drawings. The ignition system according to those embodiments is a distributor-less ignition system for vehicle engines.

(First Embodiment)

Figure 1:
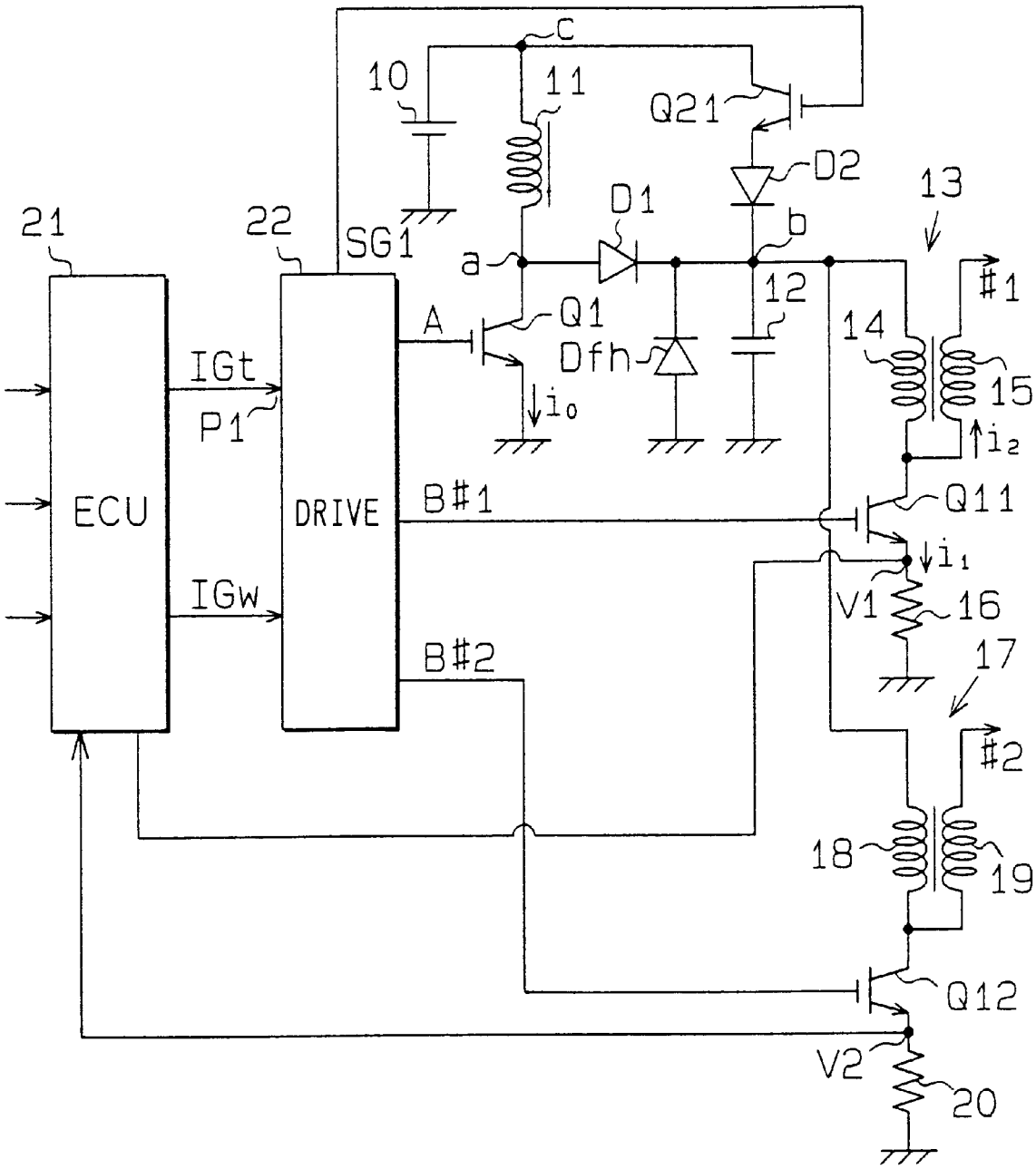
FIG. 1 is an electric circuit diagram of an ignition system for internal combustion engines according to a first embodiment of the present invention.

FIG. 1 shows a circuit arrangement of an ignition system for internal combustion engines.

In FIG. 1, an energy storage coil 11 and a transistor Q1 are connected in series between the positive terminal of a battery 10 and the ground (vehicle chassis). The battery 10 has a nominal output voltage of 12 V. The energy storage coil 11 is supplied with a current i0 to store energy by the conduction of the transistor Q1. The energy storage coil 11 and transistor Q1 have their node (a) connected to a capacitor 12 by way of a diode D1. The capacitor 12 is charged with the energy released by the energy storage coil 11.

Connected between the node (b) of the diode D1 and capacitor 12 and the ground are the primary winding 14 of an ignition coil 13 for the first cylinder of an engine (not shown), a transistor Q11 and a current detecting resistor 16 in serial connection. The transistor Q11 is turned on and off to feed the energy from the capacitor 12 to the primary winding 14 of the ignition coil 13. The primary winding 14 has a current (primary current) i1 at this time. The ignition coil 13 has its secondary winding 15 connected to an ignition plug (not shown) of the first cylinder. The secondary winding 15 generates a current (secondary current) i2 when the primary current i1 is interrupted by the transistor Q11.

Similarly, the primary winding 18 of an ignition coil 17 for the second cylinder of the engine, a transistor Q12 and a current detecting resistor 20 in serial connection are connected between the node (b) and the ground. The ignition coil 17 has its secondary winding 19 connected to an ignition plug (not shown) of the second cylinder.

The same set of the ignition coil 17, transistor Q12 and current detecting resistor 20 for the second cylinder in FIG. 1 is equipped for each of the remaining cylinders.

The capacitor 12 is connected in parallel with a flywheel diode Dfh, which conducts the current flowing through the primary winding 14 (18) when the transistor Q11 (Q12) turns off.

Connected between the node (c) of the battery 10 and energy storage coil 11 and the node (b) are a transistor Q21 and diode D2 in serial connection.

An electronic control unit (ECU) 21 functions to detect the states of engine (quantity of intake air, rotational speed, coolant temperature, etc.) based on the signals provided by the respective sensors, and determine the optimal ignition timing depending on these engine states. The ECU 21 generates a cylinder designating signal IGt and a discharge duration signal IGw to a drive circuit 22. The transistors Q1, Q11, Q12 and Q21 are connected to the drive circuit 22, which feeds a drive signal A, a drive signal B#1 for the first cylinder, a drive signal B#2 for the second cylinder and a switching drive signal SG1 to the transistors Q1, Q11, Q12 and Q21, respectively.

The ECU 21 monitors the primary current i1 of the first cylinder in terms of the voltage across the current detecting resistor 16 (voltage at circuit point V1). Similarly, the ECU 21 monitors the primary current i2 of other cylinder in terms of the voltage across the current detecting resistor 20 (voltage at circuit point V2). The ECU 21 recognizes the occurrence of system failure if the monitored voltages V1 and V2 (primary currents i1 and i2) do not reach a prescribed level a certain number of times consecutively.

The battery 10 as a d.c. power source, energy storage coil 11 and transistor Q1 as first switching device constitute a first series circuit, with the energy storage coil 11 being connected to the capacitor 12 by way of the diode D1 as reverse current blocking device. The capacitor 12, ignition coil primary winding 14 (18) and transistor Q11 (Q12) as a second switching device constitute a second series circuit. The battery 10, energy storage coil 11, diode D1, ignition coil primary winding 14 (18) and transistor Q11 (Q12) constitute another series circuit, with the diode D2 as a second reverse current blocking device being connected in parallel to the energy storage coil 11 and diode D1 in serial connection. The parallel circuit of the diode D2 includes the transistor Q21 as third switching device.

Next, the operation of the ignition system will be explained with reference to FIG. 2 and FIG. 3.

Figure 2:
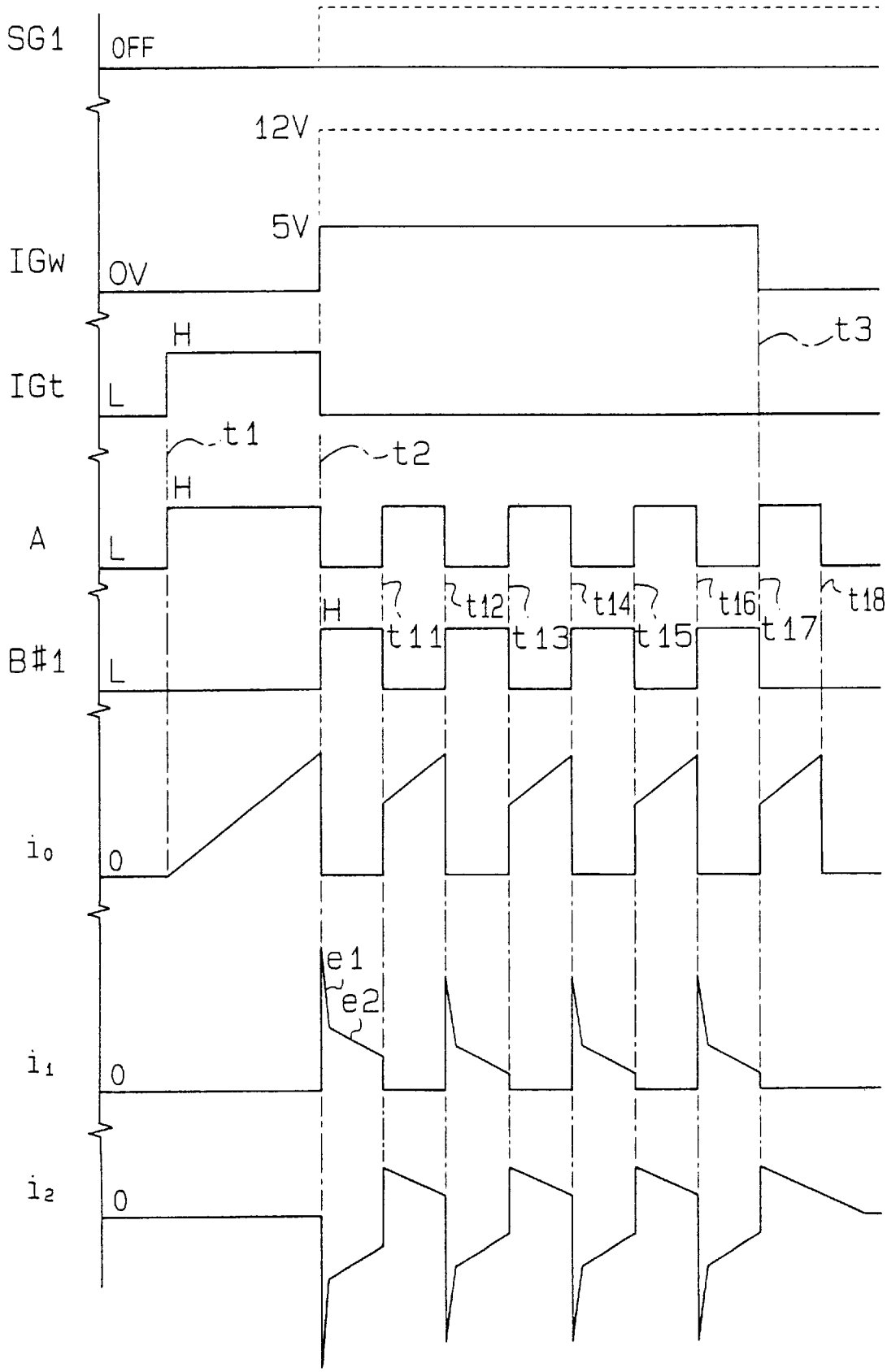
FIG. 2 is a waveform diagram of signals and currents when the ignition system is normal.

FIG. 2 shows signals and currents when the ignition system is normal. The waveforms are of the drive signal SG1 to the transistor Q21, the discharge duration signal IGw, the cylinder designating signal IGt, the drive signal A to the transistor Q1, the drive signal B#1 to the transistor Q11, the current i0 flowing through the energy storage coil 11, and the primary current i1 and secondary current i2 of the ignition coils 13 and 17.

In the normal state of the ignition system, the drive circuit 22 produces a low-level SG1 signal to keep the transistor Q21 in the off state. The ECU 21 generates the cylinder designating signal IGt, which is high during the period from t1 to t2 in FIG. 2, to the drive circuit 22. The drive circuit 22 generates the drive signal A, which is in phase with the IGt signal, to the transistor Q1. The transistor Q1 turns on, causing the current i0 to increase gradually. When the transistor Q1 turns off, the energy storage coil 11 generates high-voltage energy to the primary winding 14 of the ignition coil 14 by way of the diode D1.

The discharge duration signal IGw is high during the period from t2 to t3, and discharging takes place in this period.

Specifically, the drive circuit 22 alternates the drive signal A to the transistor Q1 at a certain interval (it rises and falls at points t11, t12, and so on) so that high-voltage energy produced by the energy storage coil 11 is stored (multiple charging) in the capacitor 12 by way of the diode D1.

During this repetitive charging operation, the drive circuit 22 generates the drive signal B#1, which is complementary to the drive signal A (it turns on and off at time points t2, t11, t12, and so on) to the transistor Q11. The B#1 signal causes the energy of the capacitor 12 to be discharged to the primary winding 14 of the ignition coil 13. When the resulting primary current i1 is shut off (time points t11, t13, t15 and t17 in FIG. 2), the large secondary current i2 (high voltage) is generated to implement the multiple ignition.

For the next ignition operation, the transistor Q1 turns on at t17 and turns off at t18 to store energy, which is produced by the energy storage coil 11 during the t17–t18 period, in the capacitor 12. Accordingly, in the immediate ignition operation, when the transistor Q11 turns on during the period from t2 to t11, energy stored in the capacitor 12 during the period from t17 to t18 (previous ignition operation) and energy produced by the energy storage coil 11 during the period from t1 to t2 are fed to the primary winding 14. Specifically, out of the primary current i1 during the period from t2 to t11, a rush current section e1 results from the energy stored in the capacitor 12 and the following moderate current section e2 results from the energy produced by the energy storage coil 11 during the period from t1 to t2.

The same operation as the foregoing for the first cylinder takes place for each of the remaining cylinders. The drive circuit 22 responds to a revised cylinder designating signal IGt to release other drive signal B#2 to other transistor Q12, thereby implementing the multiple charging and multiple ignition for that cylinder.

The drive circuit 22 turns on and off (conduction and cut-off) the transistor Q1 to charge the capacitor 12 with the energy released by the energy storage coil 11. During the ignition period, it turns on and off the transistor Q11 (Q12) to feed the energy charged in the capacitor 12 to the primary winding 14 (18) of the ignition coil 13, thereby implementing the ignition operation.

More specifically, the drive circuit 22, which receives the cylinder designating signal IGt and discharge duration signal IGw, turns on and off the transistor Q1 consecutively in the discharge duration of each cylinder thereby to implement the multiple charging of the capacitor 12, and operates the transistor Q11 (Q12) in complementary manner relative to the transistor Q1 thereby to implement the multiple ignition.

Figure 3:
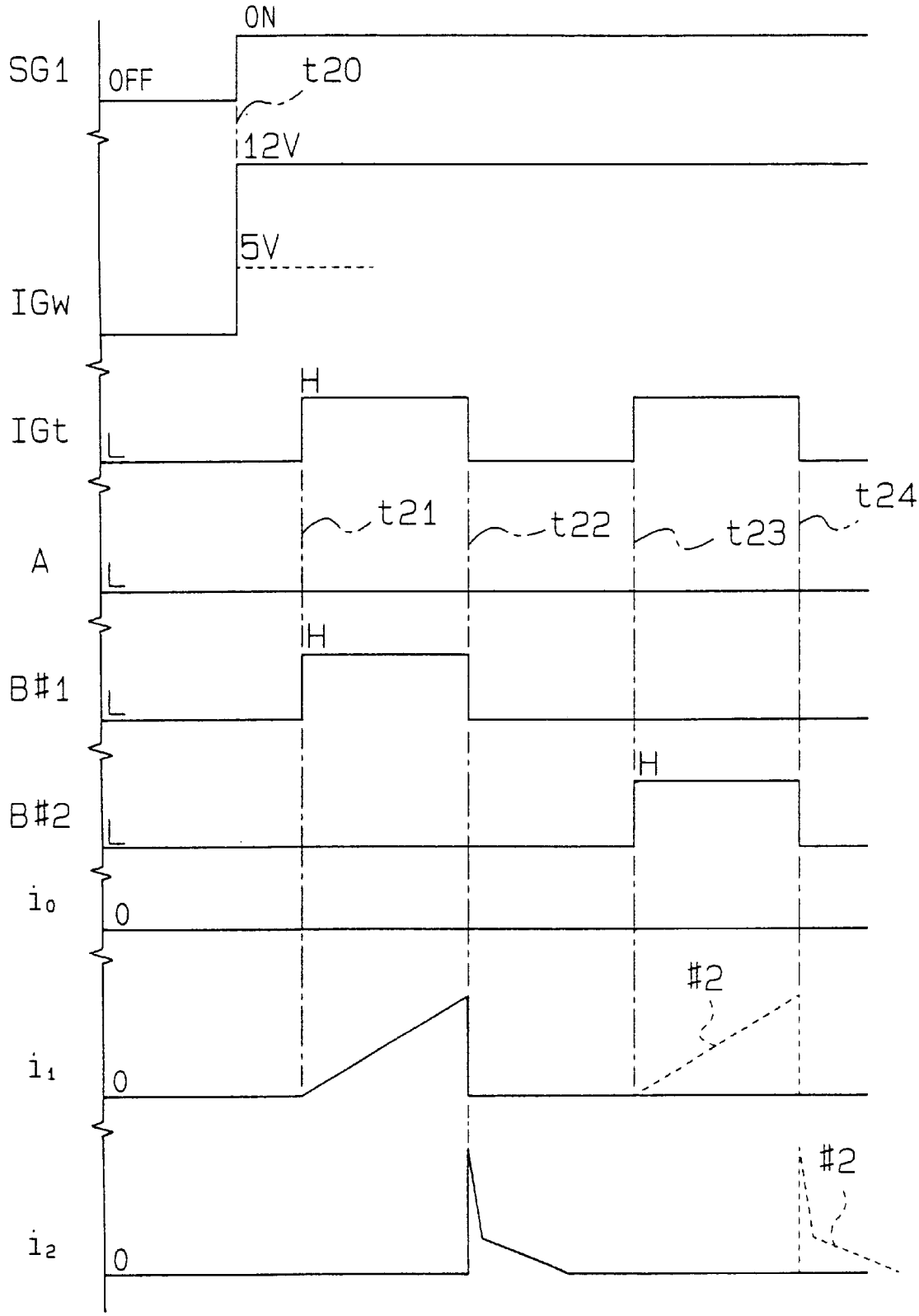
FIG. 3 is a waveform diagram of signals and currents when the ignition system fails.

FIG. 3 shows the signals and currents when the ignition system fails. The ECU 21 detects the occurrence of system failure based on the monitoring of voltages on the current detecting resistors 16 and 20, and switches the normal mode to the failsafe mode.

In the fail-safe mode, the ECU 21 generates a high-level drive signal SG1 at time point t20 in FIG. 3 to turn on the transistor Q21, and at the same time switches the voltage level of the discharge duration signal IGw from 5 V to 12 V. The drive circuit 22, which is monitoring the IGw signal voltage on the input port (P1 in FIG. 1), recognizes the fail-safe mode and generates the cylinder designating signal IGt distributively as signals B#1 and B#2 to the respective cylinders.

The signals B#1 and B#2 turn on and off the transistors Q11 and Q12, respectively. Specifically, the transistor Q11 of the first cylinder turns on at time point t21 and turns off at t22 in FIG. 3. During the on-period of the transistor Q11, energy from the battery 10 is fed to the primary winding 14 of the ignition coil 13 by way of the diode D2, and at the shut-off of the primary current i1 of the ignition coil 13 (time point t22 in FIG. 3), the ignition coil 13 produces a large secondary current i2 (high voltage) for ignition. Similarly, for the second cylinder, the transistor Q12 turns on at time point t23 and turns off at t24 in FIG. 3 to implement the ignition.

In this manner, in the event of failure of the energy storage coil 11, transistor Q1, diode D1, capacitor 12, or associated wiring, the drive circuit 22 operates the transistor Q11 (Q12) to turn on and off (conduction and cut-off) so that energy from the battery 10 is fed to the primary winding 14 (18) of the ignition coil 13 by way of the diode D2, thereby enabling the rimp-home performance. The diode D2 also functions in the normal mode to prevent the energy stored in the capacitor 12 from flowing back to the battery 10.

In this manner, the ignition coil 13 (17) operates by being supplied with energy from the battery 10 through the bypass at the occurrence of failure of the ignition current path, thereby enabling the rimp-home performance. In consequence, the ignition operation based on one battery 10 can be performed both in the normal state and in the event of system failure by the simpler ignition system for internal combustion engines having the fail-safe function.

Particularly, the drive circuit 22 switches the transistor Q21 from off to on at the occurrence of system failure, and the energy path from the battery 10 to the primary winding 14 (18) of the ignition coil 13 by way of the diode D2 can surely be shut off in the normal mode.

In addition, the drive circuit 22 turns on and off the transistor Q11 (Q12) by being timed to the cylinder designating signal IGt. These transistors can readily be controlled without the need of producing a special signal at the occurrence of system failure.

In addition, the discharge duration signal IGw, which is not used in the fail-safe mode, has its signal level switched so that it effectively carries the mode switching information.

(Second Embodiment)

Figure 4:
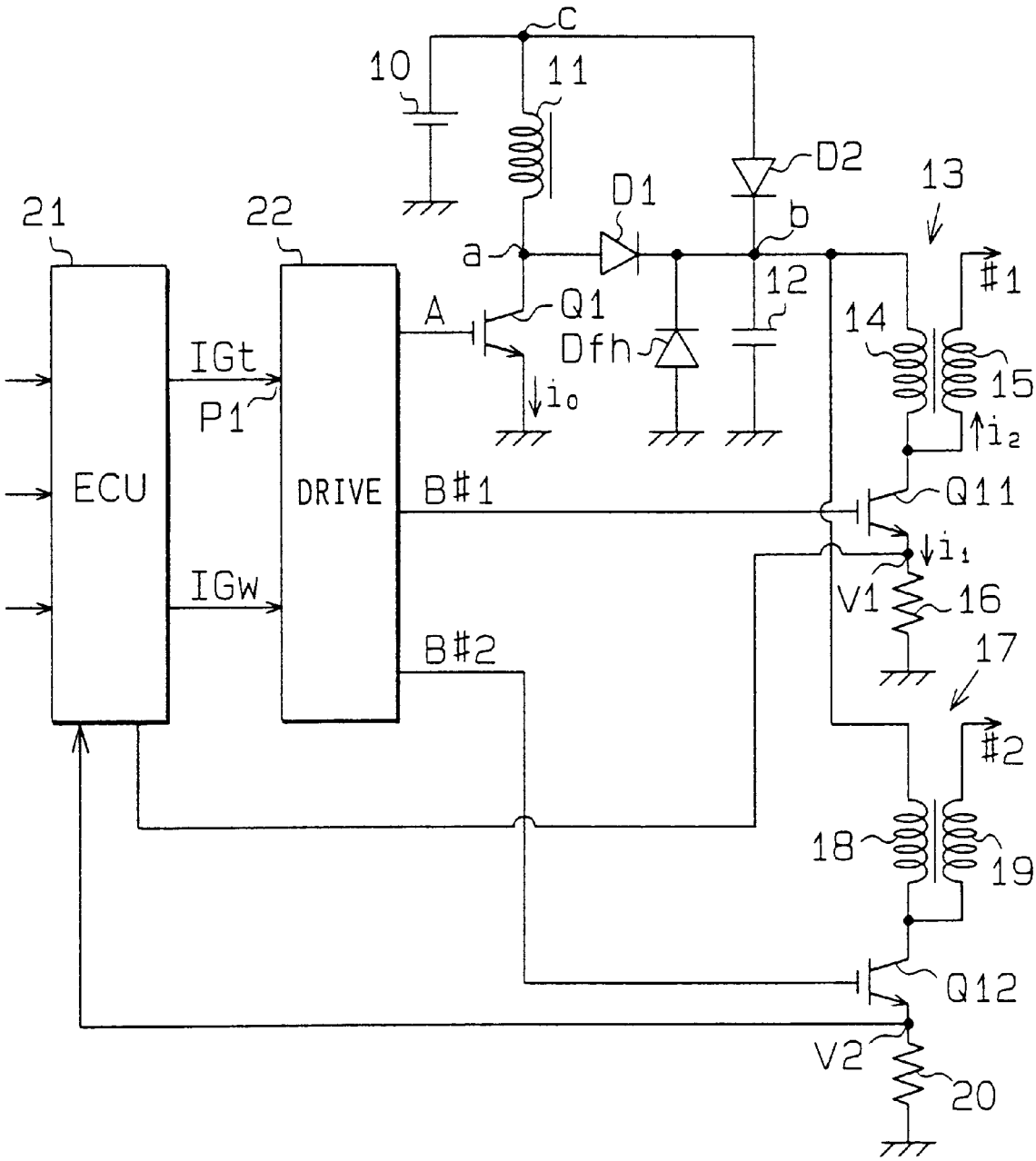
FIG. 4 is an electric circuit diagram of an ignition system for internal combustion engines according to a second embodiment of the present invention.

In this embodiment, the energy bypass made up of the transistor Q21 and diode D2 in the first embodiment (FIG. 1) is altered to include only the diode D2 as shown in FIG. 4.

(Third Embodiment)

Figure 5:
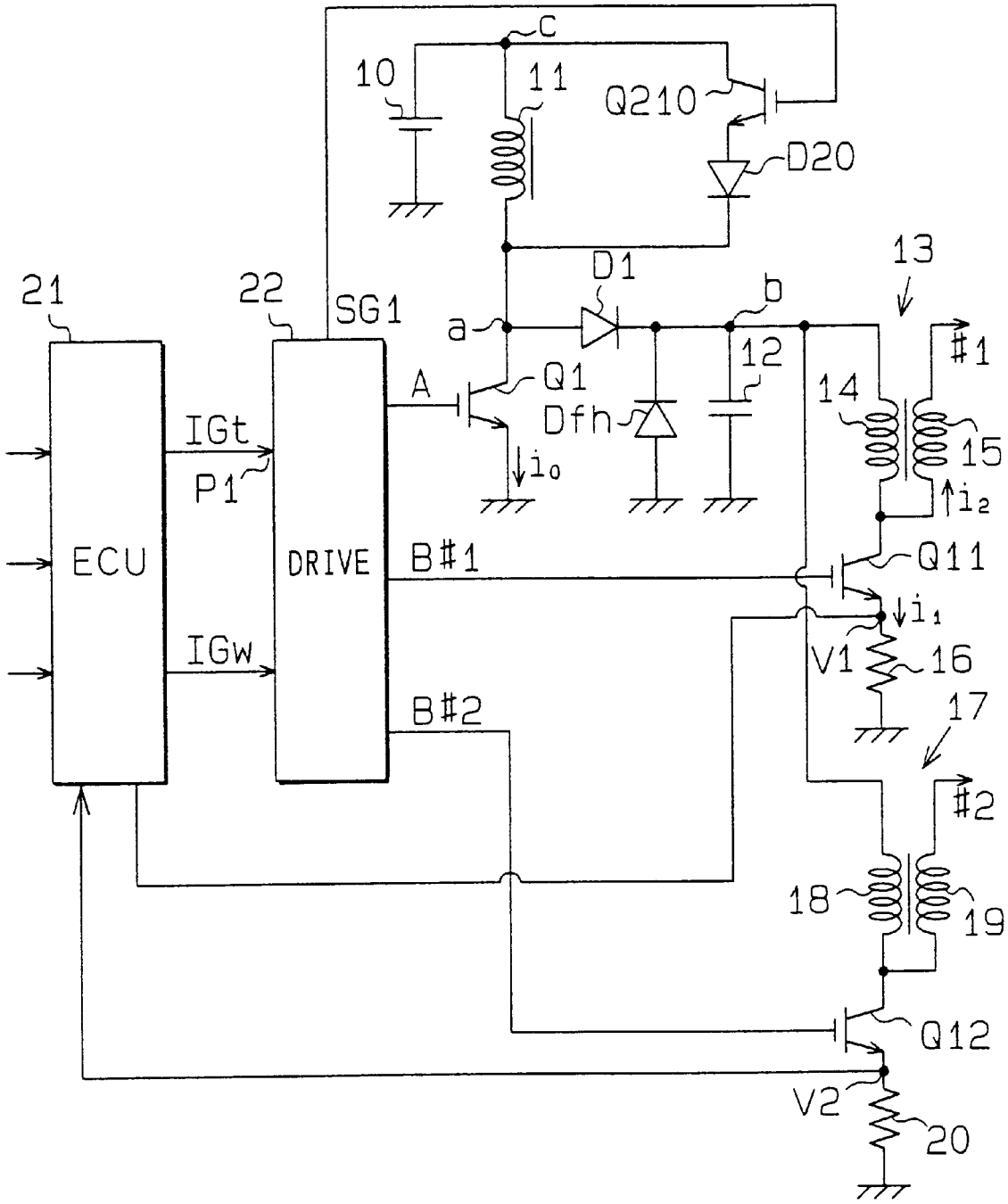
FIG. 5 is an electric circuit diagram of an ignition system for internal combustion engines according to a third embodiment of the present invention.

In this embodiment, the parallel connection of the diode D2 (and transistor Q21) to the energy storage coil 11 and diode D1 in serial connection in the first embodiment (FIG. 1) is altered to a parallel connection of a diode D20 (reverse current blocking device) and a transistor Q210 in serial connection to the energy storage coil 11 as shown in FIG. 5. Thus, energy from the battery 10 is fed to the primary winding 14 (18) of the ignition coil 13 by way of the diodes D1 and D20 by the switching operation of the transistor Q11 at the occurrence of system failure. In this case, the diode D20 functions to prevent the energy stored in the energy storage coil 11 from flowing back to the battery 10 in the normal mode.

The arrangement of FIG. 5, however, cannot cope with the failure of diode D1 in contrast to the arrangement of FIG. 1. Therefore the diode D1 of FIG. 6 has preferably a marginal durability in terms of the breakdown voltage and the like.

The drive circuit 22 switches from off to on the transistor Q21 as the third switching device which is included together with the diode D20 in the parallel circuit of FIG. 5, and in consequence the energy path from the battery 10 to the ignition coil primary winding by way of the diodes D1 and D20 can surely be shut off in the normal mode.

As a variant arrangement, the energy bypass made up of the transistor Q21 and diode D20 in FIG. 5 may be altered to include only the diode D20.

The transistors Q1, Q11, Q12, Q21 and Q210 in FIG. 1 and FIG. 5 can be switching transistors of any type including bipolar transistors, FETs (preferably p-channel MOSFETs), and IGBTs.

Detection of system failure, which is implemented by monitoring the primary current i1 flowing through the resistors 16 and 20 in the arrangements of FIG. 1 and FIG. 5 may be otherwise based on a different scheme such as the monitoring of the ion current.

Next, indication of the mode switching signal from the ECU 21 to the drive circuit 22 will be explained.

Figure 6:
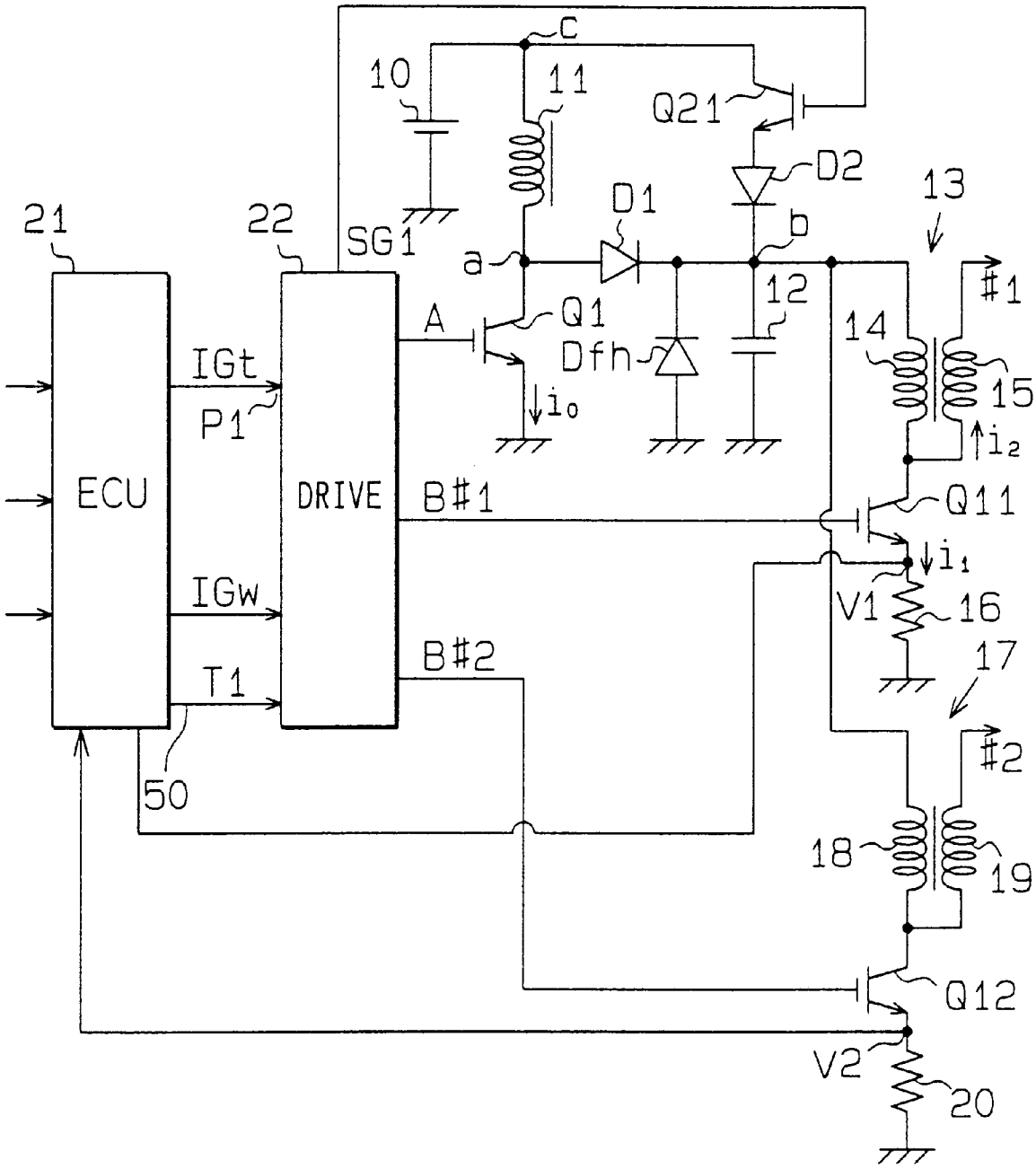
FIG. 6 is an electric circuit diagram showing a comparative ignition system for internal combustion engines.
Figure 7:
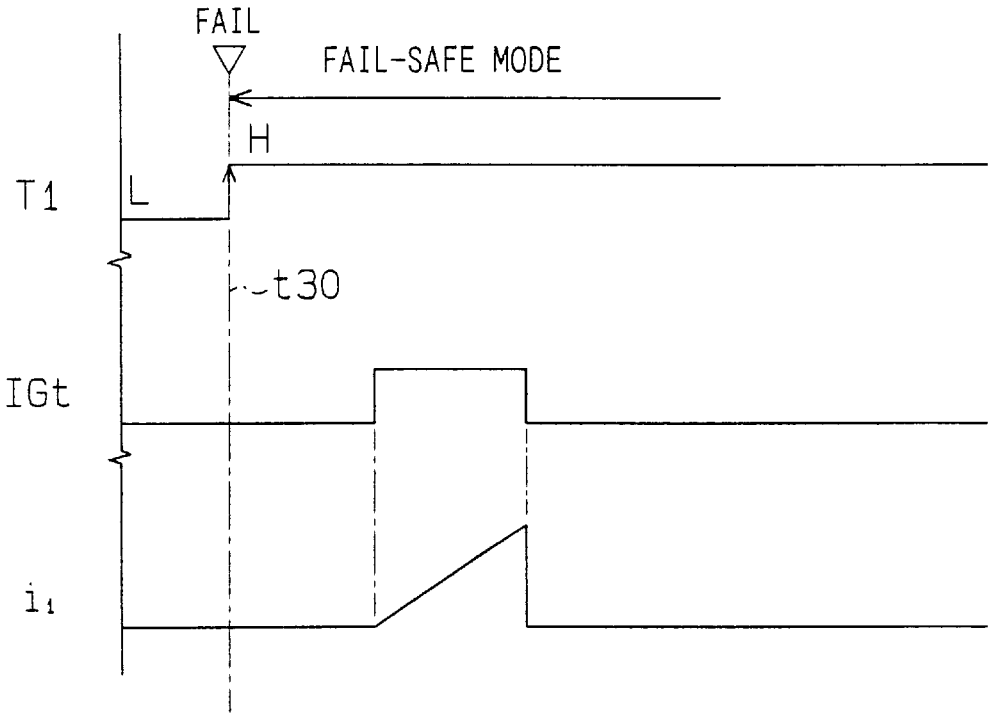
FIG. 7 is a waveform diagram used to explain a comparative switching operation to bring the system into a fail-safe mode.
Figure 8:
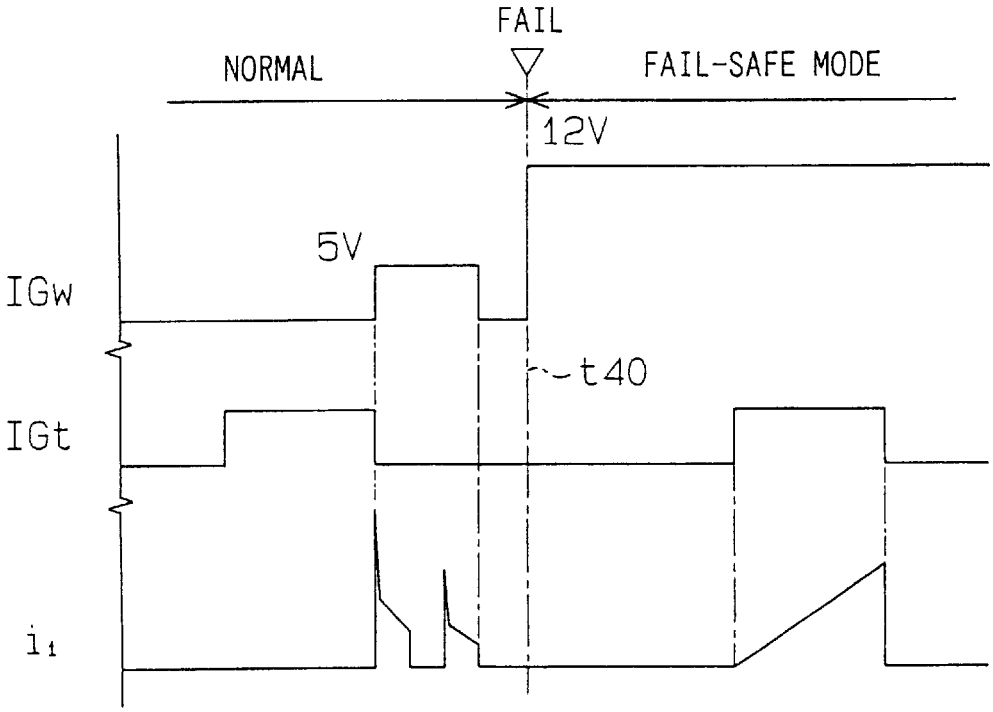
FIG. 8 is a waveform diagram used to explain the switching operation of the third embodiment to bring the system into a fail-safe mode.

Generally, the ECU 21 and the drive circuit 22 are connected by a signal line 50 as shown in FIG. 6, and the mode switching signal T1 has its signal level turned at the detection of system failure (time point t30) as shown in FIG. 7. This simple signal indication scheme however necessitates an additional signal line 50. In contrast, the foregoing embodiments implement this action by switching the voltage level of the discharge duration signal IGw from 5 V to 12 V at the detection of system failure (time point t40) as shown in FIG. 8, thereby eliminating the need of additional signal line.

(Fourth Embodiment)

Figure 9:
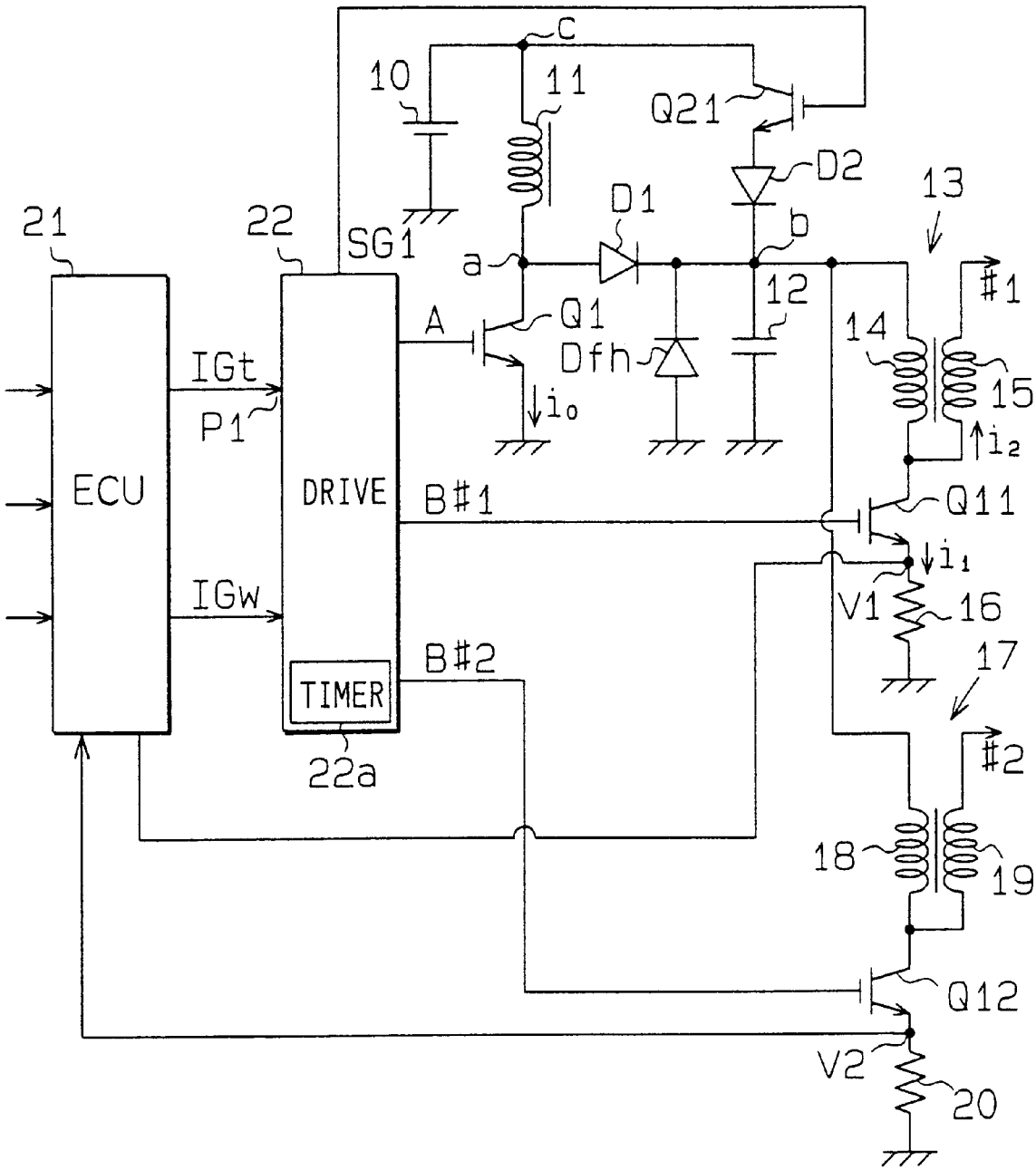
FIG. 9 is an electric circuit diagram of an ignition system for internal combustion engines according to a fourth embodiment of the present invention.
Figure 10:
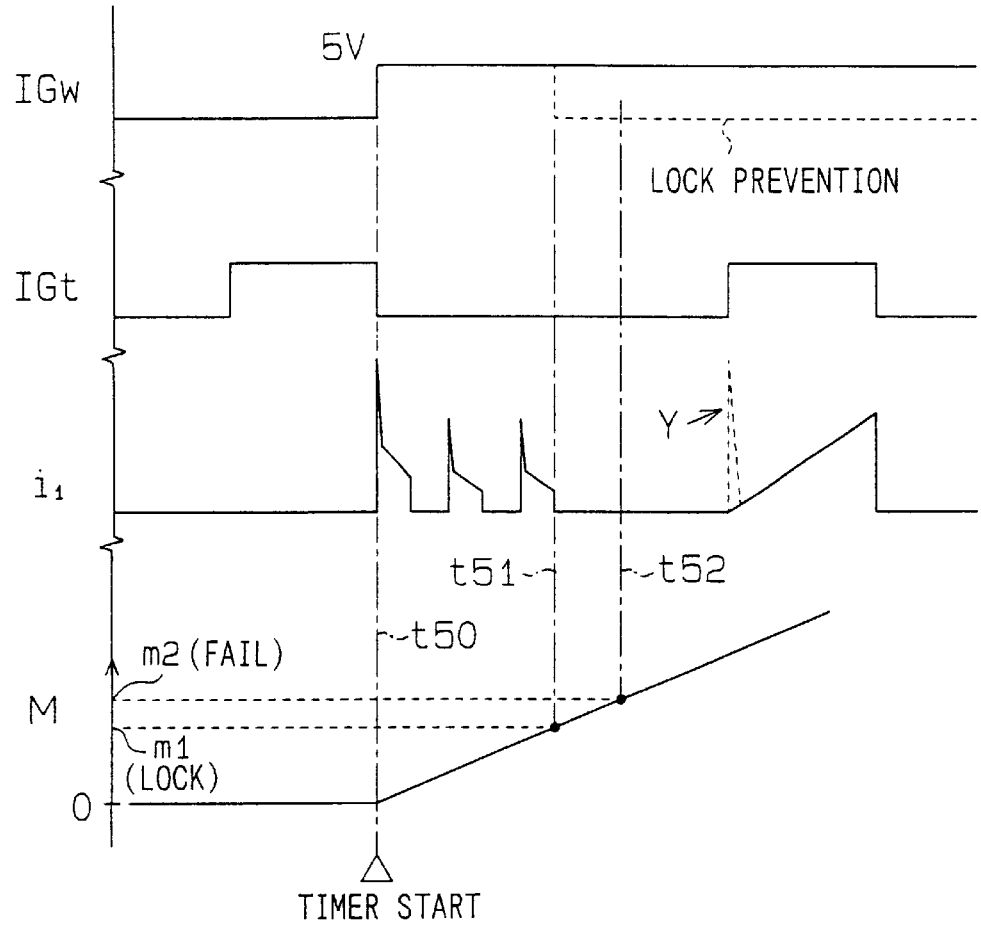
FIG. 10 is a waveform diagram used to explain the switching operation of the fourth embodiment to bring the system into a fail-safe mode.

In this embodiment, as shown in FIG. 9, a timer 22*a* is provided in the drive circuit 22. The discharge duration signal IGw is fixed to the high level (5 V) at the detection of system failure as shown in FIG. 10, and the timer 22*a* detects the expiration of a certain time length m2 to trigger the operation of fail-safe mode. This scheme is accompanied by a lock preventing function which halts the multiple charging and multiple ignition operation if the IGw signal stays at the high level by some cause (short-circuit of power line, etc.). The timer 22*a* starts counting time M when the discharge duration signal IGw goes high (time point t50) in FIG. 10 and triggers the lock preventing operation on expiration of the threshold m1 of lock prevention (time point t51). The timer 22*a* continues counting after the count value m1, and triggers the operation of fail-safe mode when it exceeds the threshold m2 of system failure (time point t52). In consequence, the ignition operation takes place at the next cylinder designating signal IGt, i.e., ignition coil feed signal.

In this manner, the discharge duration signal IGw for switching to the fail-safe mode is kept at the high level (or low level), while the discharge duration signal IGw, which is unused in the fail-safe mode, has its signal waveform varied uniquely so that it effectively carries the mode switching information. This scheme eliminates the need of additional signal line as compared with the scheme shown in FIG. 6 and FIG. 7.

In contrast to the scheme shown in FIG. 8 which needs to cope with the matter of erroneous triggering of the fail-safe operation caused by a noise emerging on the IGw signal line, the scheme shown in FIG. 9 and FIG. 10 does not trigger the fail-safe operation until the count value reaches m2 even in the presence of noises on the IGw signal line. This noise filtering function for the discharge duration signal IGw gains the immunity against malfunctioning.

Moreover, the lock preventing operation halts the charging operation for the next ignition operation, enabling the smooth switching operation. More specifically, in contrast to the absence of lock preventing operation in which case the drive signal A is high in the period from t17 to t18, causing the next charging operation to produce a primary current i1 as shown by Y in FIG. 10, resulting in an ignition timing shift, whereas the presence of lock preventing operation halts the next charging operation and the spike current shown by Y does not arise.

Moreover, the scheme of FIG. 8 necessitates the supply of 12 V on the part of the ECU 21 (e.g., wiring of the 12 V power line), whereas the scheme shown in FIG. 9 and FIG. 10 does not need it.

Instead of the triggering of fail-safe operation by the drive circuit 22 when the timer count value M reaches m2 after exceeding m1 of lock preventing operation in FIG. 10, the thresholds m1 and m2 of lock preventing operation and fail-safe operation may be set equal.

(Fifth Embodiment)

Figure 12:
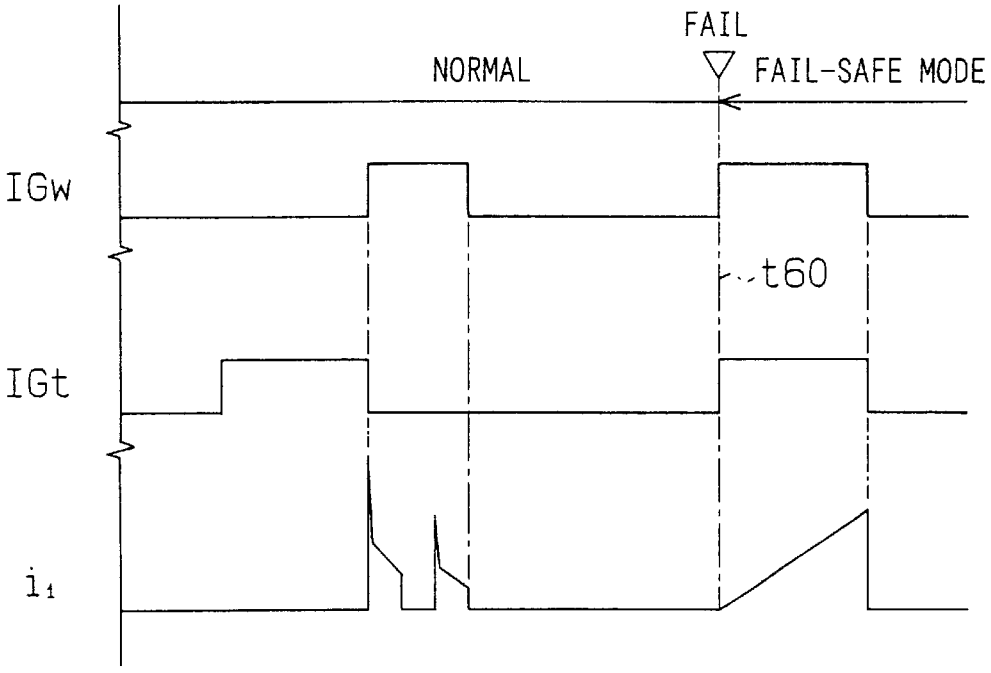
FIG. 12 is a waveform diagram used to explain the switching operation of the fifth embodiment to bring the system into a fail-safe mode.
Figure 11:
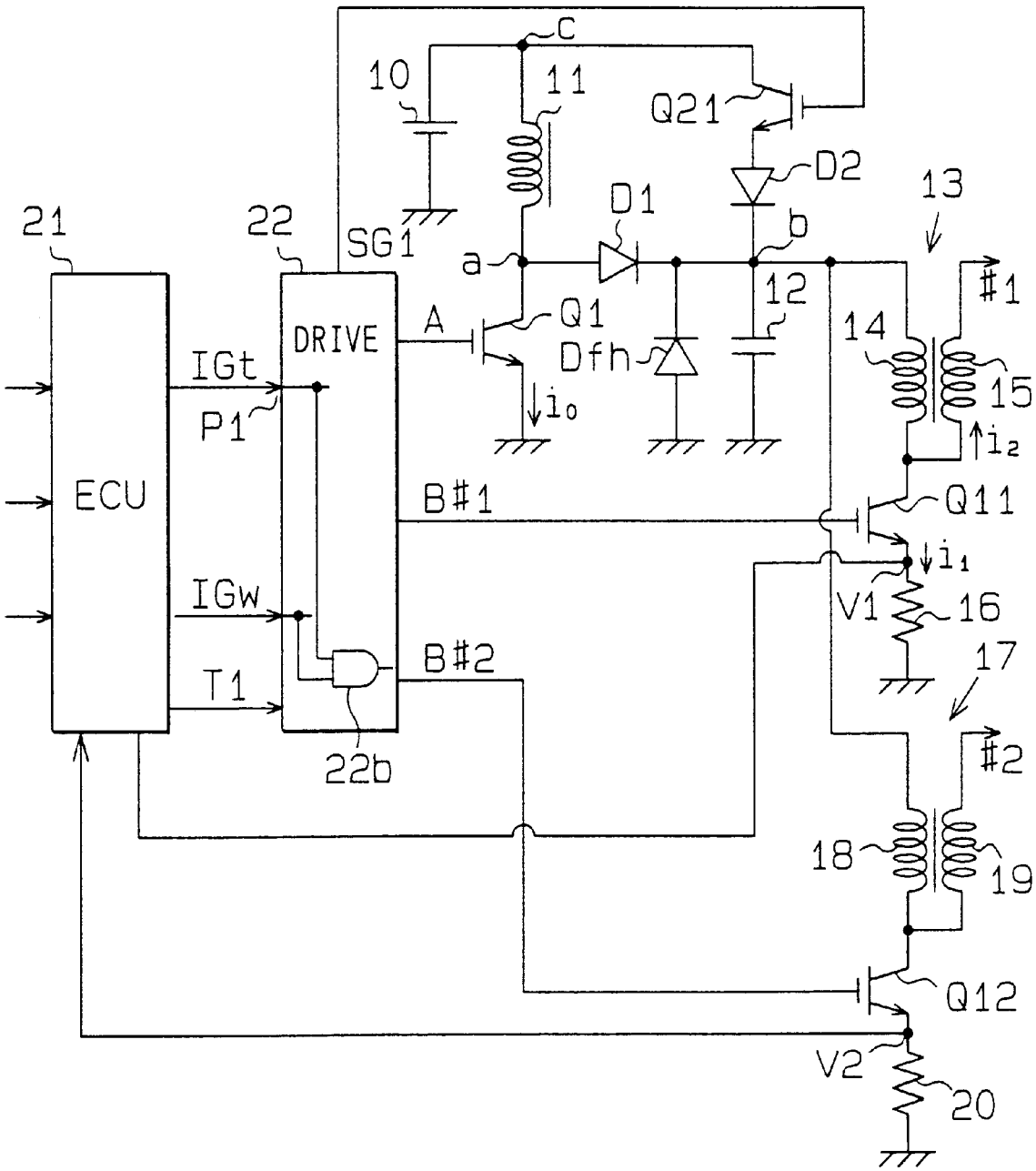
FIG. 11 is an electric circuit diagram of an ignition system for internal combustion engines according to a fifth embodiment of the present invention.

In this embodiment, as shown in FIG. 11, an AND gate 22*b* is provided for the drive circuit 22, with the IGt and IGw signals being applied to the AND gate 22*b*. At the detection of system failure (time point t60), the cylinder designating signal IGt and discharge duration signal IGw are brought to the high level as shown in FIG. 12, which the AND gate 22*b* detects to trigger the fail-safe operation. Namely, in the normal state, the discharge duration signal IGw has a high-level period only after the high-level period of the cylinder designating signal IGt. An event of coincident high-level IGt and IGw signals is used to trigger the fail-safe operation.

This scheme, which makes the cylinder designating signal IGt and discharge duration signal IGw out of phase with each other in the normal state and indicates the mode switching information by making these signals in phase, can also eliminate the need of additional signal line as compared with the scheme shown in FIG. 6 and FIG. 7. Namely, the signal, which is unused in the fail-safe mode, is used so that it effectively carries the mode switching information. Moreover, in contrast to the scheme of FIG. 8 which necessitates the supply of 12 V on the part of the ECU 21 (e.g., wiring of the 12 V power line), the scheme shown in FIG. 11 and FIG. 12 does not need it.

The present invention should not be limited to the disclosed embodiment, but may be implemented in many other ways without departing from the spirit of the invention.

What is claimed is:

1. An ignition system for internal combustion engines comprising:

a first series circuit including a d.c. power source, an energy storage coil, and a first switching device;

a capacitor connected to the energy storage coil by way of a first reverse current blocking device;

a second series circuit including a capacitor, a primary winding of an ignition coil, and a second switching device;

a first switching device control means for turning on and off the first switching device to charge the capacitor with energy released by the energy storage coil, and turning on and off the second switching device during an ignition period thereby to feed the energy stored in the capacitor to the primary winding of the ignition coil;

a second reverse current blocking device connected in parallel to the energy storage coil and the first reverse current blocking device in serial connection out of a series circuit including the d.c. power source, the energy storage coil, the first reverse current blocking device, the primary winding of the ignition coil, and the second switching device; and a second switching device control means for turning on and off the second switching device during the ignition period at an occurrence of system failure thereby to feed energy of the d.c. power source to the primary winding of the ignition coil by way of the second reverse current blocking device.

2. The ignition system as in claim 1 further comprising:

a third switching device connected in the parallel circuit including the second reverse current blocking device; and a third switching device control means for switching the third switching device from the off state to the on state at the occurrence of system failure.

3. The ignition system as in claim 1, wherein:

the first switching device control means receives a cylinder designating signal and discharge duration signal, turns on and off consecutively the first switching device thereby to charge the capacitor in a multiple manner during a prescribed discharge duration for each cylinder of the engine and operates the second switching device in a complementary relation with the first switching device; and the second switching device control means receives the cylinder designating signal and turns on and off the second switching device by being in phase with the cylinder designating signal.

4. The ignition system as in claim 3, wherein:

the discharge duration signal, which is unused in the fail-safe mode, is switched in signal level thereby to indicate mode switching information.

5. The ignition system as in claim 3, wherein:

the discharge duration signal, which is unused in the fail-safe mode, is varied in signal waveform thereby to indicate mode switching information.

6. The ignition system as in claim 5, wherein:

the waveform of the discharge duration signal for indicating the switching to the fail-safe mode is represented by a continuous fixed signal level.

7. The ignition system as in claim 3, wherein:

the cylinder designating signal and the discharge duration signal are made out of phase with each other in the normal mode; and the cylinder designating signal and discharge duration signal are made in phase with each other to indicate mode switching information.

8. An ignition system for internal combustion engine comprising:

a first series circuit which includes a d.c. power source, an energy storage coil, and a first switching device;

a capacitor which is connected to the energy storage coil by way of a first reverse current blocking device;

a second series circuit which includes a capacitor, a primary winding of an ignition coil, and a second switching device;

a first switching device control means which turns on and off the first switching device to charge the capacitor with energy released by the energy storage coil, and turns on and off the second switching device during an ignition period thereby to feed the energy stored in the capacitor to the primary winding of the ignition coil;

a second reverse current blocking device which is connected in parallel to the energy storage coil; and a second switching device control means which turns on and off the second switching device during the ignition period at the occurrence of system failure thereby to feed energy of the d.c. power source to the primary winding of the ignition coil by way of the first and second reverse current blocking devices.

9. The ignition system as in claim 8 further comprising:

a third switching device which is connected in the parallel circuit including the second reverse current blocking device; and a third switching device control means which switches the third switching device from the off state to the on state at an occurrence of system failure.

10. The ignition system as in claim 8, wherein:

the first switching device control means receives a cylinder designating signal and discharge duration signal, turns on and off consecutively the first switching device thereby to charge the capacitor in a multiple manner during a prescribed discharge duration for each cylinder of the engine and operates the second switching device in a complementary relation with the first switching device; and the second switching device control means receives the cylinder designating signal and turns on and off the second switching device by being in phase with the cylinder designating signal.

11. The ignition system as in claim 10, wherein:

the discharge duration signal, which is unused in the fail-safe mode, is switched in signal level thereby to indicate mode switching information.

12. The ignition system as in claim 10, wherein:

the discharge duration signal, which is unused in the fail-safe mode, is varied in signal waveform thereby to indicate mode switching information.

13. The ignition system as in claim 12, wherein:

the waveform of the discharge duration signal for indicating the switching to the fail-safe mode is represented by a continuous fixed signal level.

14. The ignition system as in claim 10, wherein:

the cylinder designating signal and the discharge duration signal are made out of phase with each other in the normal mode; and the cylinder designating signal and discharge duration signal are made in phase with each other to indicate mode switching information.

* * * * *